US008492666B2

(12) United States Patent
Chen et al.

(10) Patent No.: US 8,492,666 B2
(45) Date of Patent: Jul. 23, 2013

(54) KEY ASSEMBLY FOR A MOBILE DEVICE

(75) Inventors: Chao Chen, Waterloo (CA); Michael Welker, Waterloo (CA); Dietmar Wennemer, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 390 days.

(21) Appl. No.: 12/831,834

(22) Filed: Jul. 7, 2010

(65) Prior Publication Data

US 2012/0006667 A1 Jan. 12, 2012

(51) Int. Cl.
*H01H 9/26* (2006.01)
*H01H 13/72* (2006.01)
*H01H 13/76* (2006.01)

(52) U.S. Cl.
USPC ..... 200/5 B; 200/5 A; 200/339

(58) Field of Classification Search
USPC ..... 200/5 B
See application file for complete search history.

(56) References Cited

U.S. PATENT DOCUMENTS

| | | | | |
|---|---|---|---|---|
| 6,603,086 | B2 | 8/2003 | Kawaguchi et al. | |
| 7,096,036 | B2 | 8/2006 | Griffin et al. | |
| 7,272,411 | B2 | 9/2007 | Griffin et al. | |
| 7,324,091 | B2 * | 1/2008 | Fyke | 345/168 |
| 7,502,462 | B2 | 3/2009 | Rak et al. | |
| 7,504,967 | B2 | 3/2009 | Griffin | |
| 7,561,685 | B2 | 7/2009 | Griffin | |
| 7,606,043 | B2 | 10/2009 | Stokholm et al. | |
| 7,626,516 | B2 | 12/2009 | Griffin et al. | |
| 7,658,561 | B2 | 2/2010 | Vuong | |
| 2001/0003539 | A1 | 6/2001 | Hahm et al. | |
| 2002/0109614 | A1 | 8/2002 | Kim | |
| 2006/0252454 | A1 | 11/2006 | Griffin et al. | |
| 2007/0188462 | A1 | 8/2007 | Lee et al. | |
| 2007/0192711 | A1 | 8/2007 | Lee et al. | |
| 2007/0252817 | A1 | 11/2007 | Griffin et al. | |
| 2007/0254688 | A1 | 11/2007 | Griffin et al. | |
| 2007/0254689 | A1 | 11/2007 | Griffin et al. | |
| 2007/0254690 | A1 | 11/2007 | Griffin et al. | |
| 2007/0254698 | A1 | 11/2007 | Griffin et al. | |
| 2007/0254699 | A1 | 11/2007 | Griffin et al. | |

(Continued)

FOREIGN PATENT DOCUMENTS

| | | | |
|---|---|---|---|
| EP | 1696448 | A1 | 8/2006 |
| WO | W02009146758 | A1 | 12/2009 |

OTHER PUBLICATIONS

European Patent Office, Extended European Search Report, Application No. 10168743.2, Dec. 13, 2010.

*Primary Examiner* — Renee Luebke
*Assistant Examiner* — Lheiren Mae Caroc
(74) *Attorney, Agent, or Firm* — Quarles & Brady LLP; Tim Clise

(57) ABSTRACT

A key assembly for an electronic device comprises at least one key including a body having a first external contact portion and a second external contact portion. The first external contact portion is movable to thereby actuate a first switch of a pair of switches. The second external contact portion is movable to thereby actuate a second switch of the pair of switches. The body of the at least one key pivots about the first external contact portion when the second external contact portion moves to thereby actuate the second switch. The body of the at least one key also pivots about the second external contact portion when the first external contact portion moves to thereby actuate the first switch.

14 Claims, 6 Drawing Sheets

U.S. PATENT DOCUMENTS

| | | | |
|---|---|---|---|
| 2007/0254700 | A1 | 11/2007 | Griffin et al. |
| 2007/0254701 | A1 | 11/2007 | Griffin et al. |
| 2007/0254702 | A1 | 11/2007 | Griffin et al. |
| 2007/0254703 | A1 | 11/2007 | Griffin et al. |
| 2007/0254704 | A1 | 11/2007 | Griffin et al. |
| 2007/0254705 | A1 | 11/2007 | Griffin et al. |
| 2007/0254706 | A1 | 11/2007 | Griffin et al. |
| 2007/0254707 | A1 | 11/2007 | Griffin et al. |
| 2007/0254708 | A1 | 11/2007 | Griffin et al. |
| 2007/0254721 | A1 | 11/2007 | Griffin et al. |
| 2007/0259697 | A1 | 11/2007 | Griffin et al. |
| 2007/0268259 | A1 | 11/2007 | Griffin et al. |
| 2007/0275753 | A1 | 11/2007 | Griffin et al. |
| 2009/0058809 | A1 | 3/2009 | Vuong et al. |
| 2009/0073115 | A1 | 3/2009 | Chen et al. |
| 2009/0128369 | A1 | 5/2009 | Rak et al. |
| 2009/0195508 | A1 | 8/2009 | Griffin |
| 2009/0256728 | A1 | 10/2009 | Griffin |

* cited by examiner

KEY ASSEMBLY FOR A MOBILE DEVICE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE DISCLOSURE

The present disclosure relates generally to input devices, and more particularly to key assemblies for handheld electronic devices, and more particularly to a key assembly for handheld electronic devices having a plurality of double keys.

Keypad and keyboard designs in handheld electronic devices often attempt to balance several design constraints, which may include the ability to provide illuminated keys, a visual separation between keys, a tactile separation between keys, tactile feedback to device users in response to a key press, and provision of such features within a relatively thin device profile.

Modern keypad and keyboard designs often utilize dome switches rather than mechanical "hard closing" switches to provide a thinner device profile. Depending on the keypad or keyboard design which is used, the use of dome switches may result in keys which are wobbly and unstable, and more prone to damage.

DETAILED DESCRIPTION OF THE DRAWINGS

Figure 1:
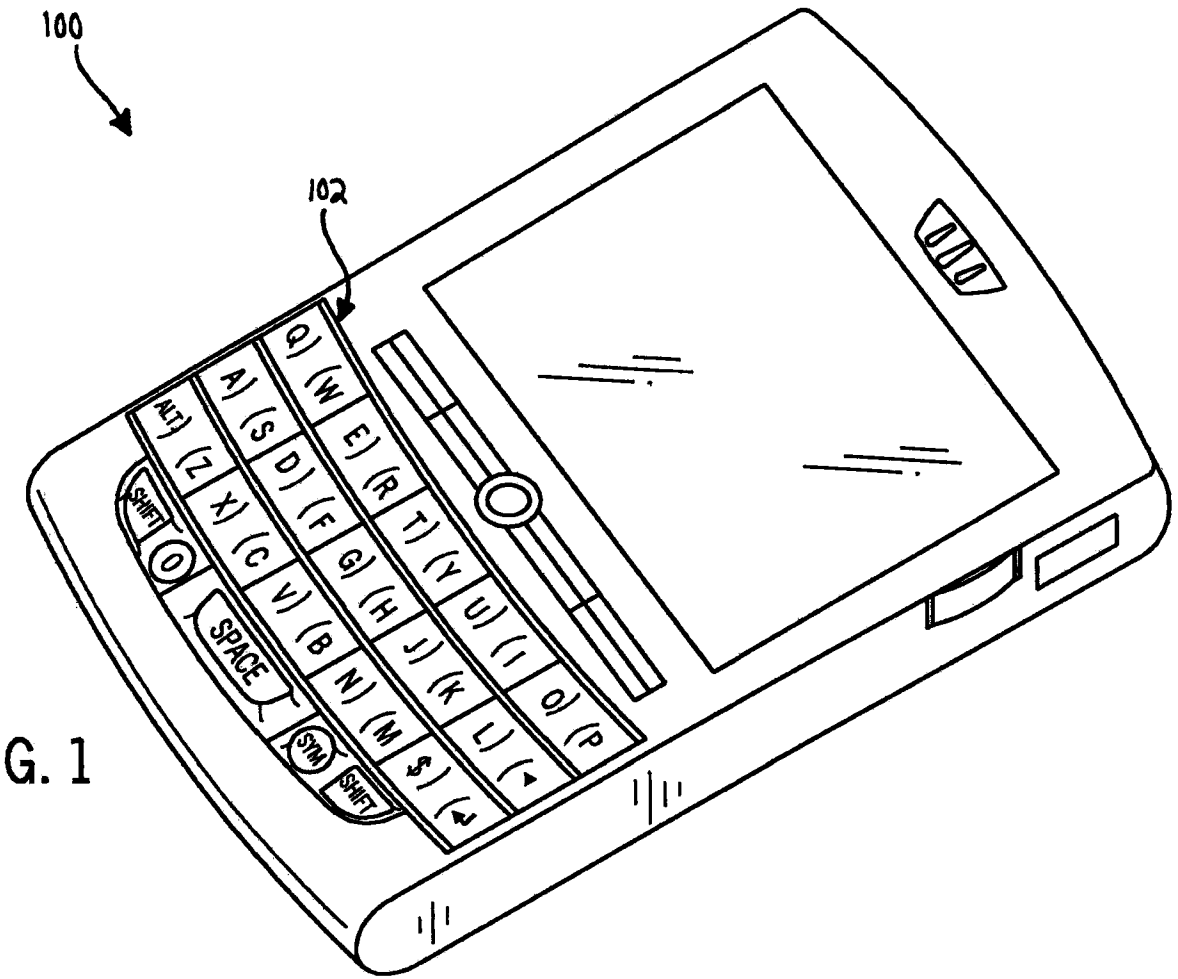
FIG. 1 is a front perspective view of an electronic device having a key assembly including a plurality of double keys.
Figure 2:
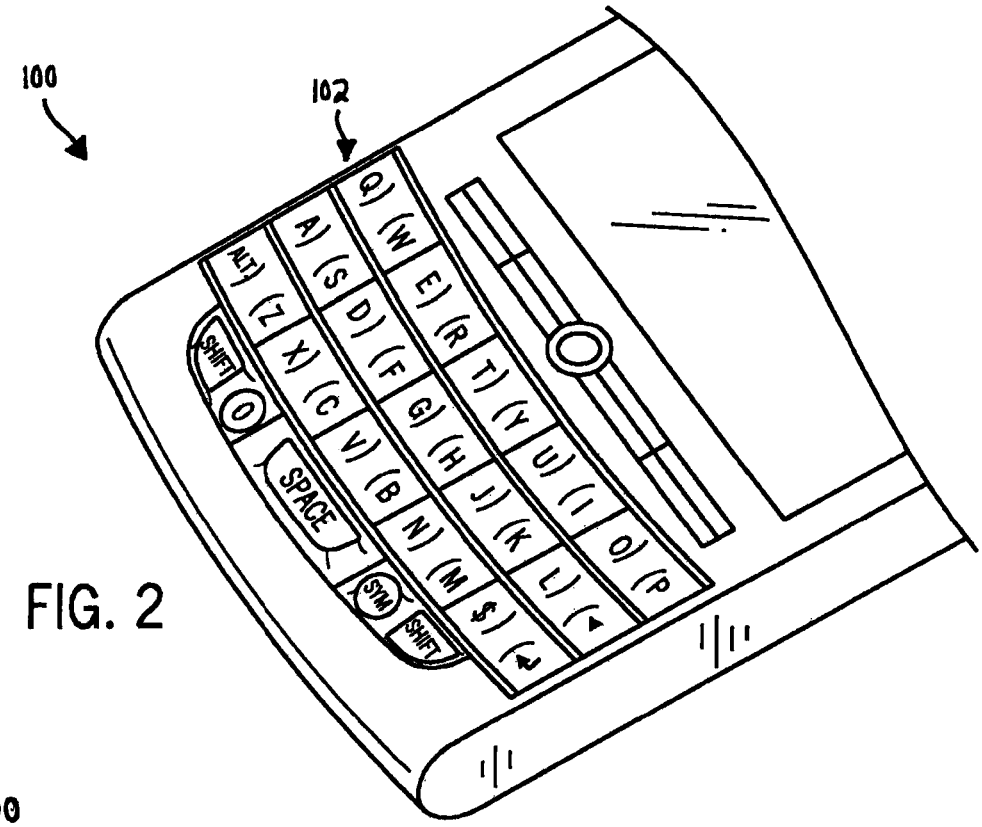
FIG. 2 is a partial perspective view of the electronic device and the key assembly of FIG. 1.
Figure 3:
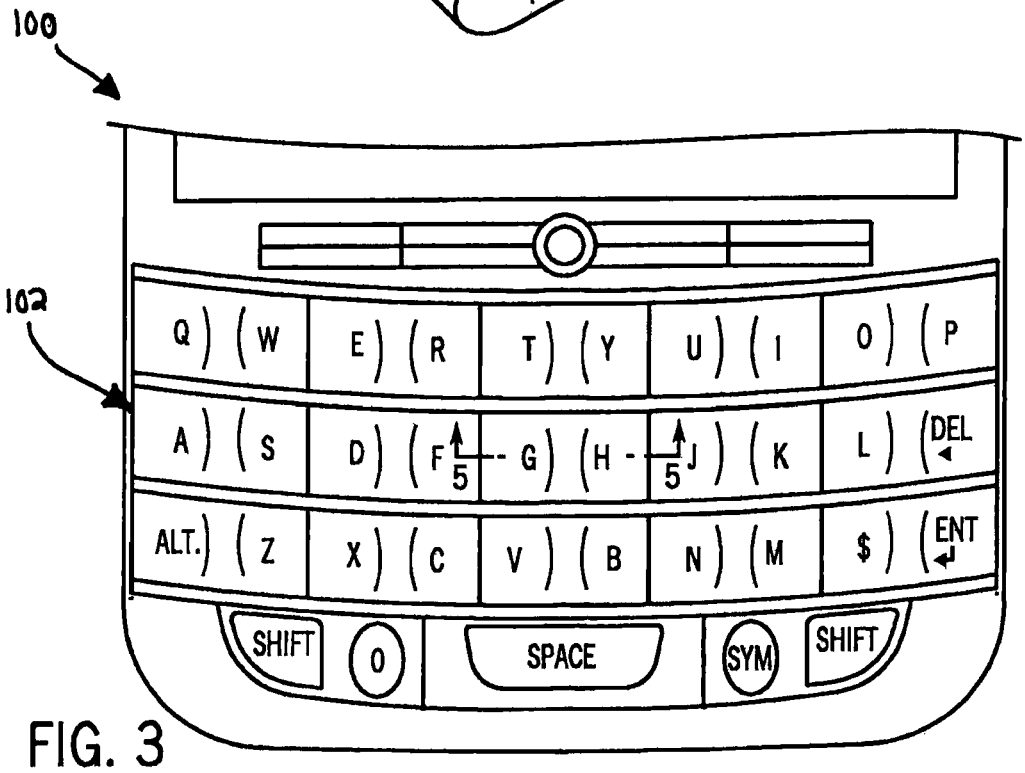
FIG. 3 is a front view of the electronic device and the key assembly of FIG. 1.
Figure 4:
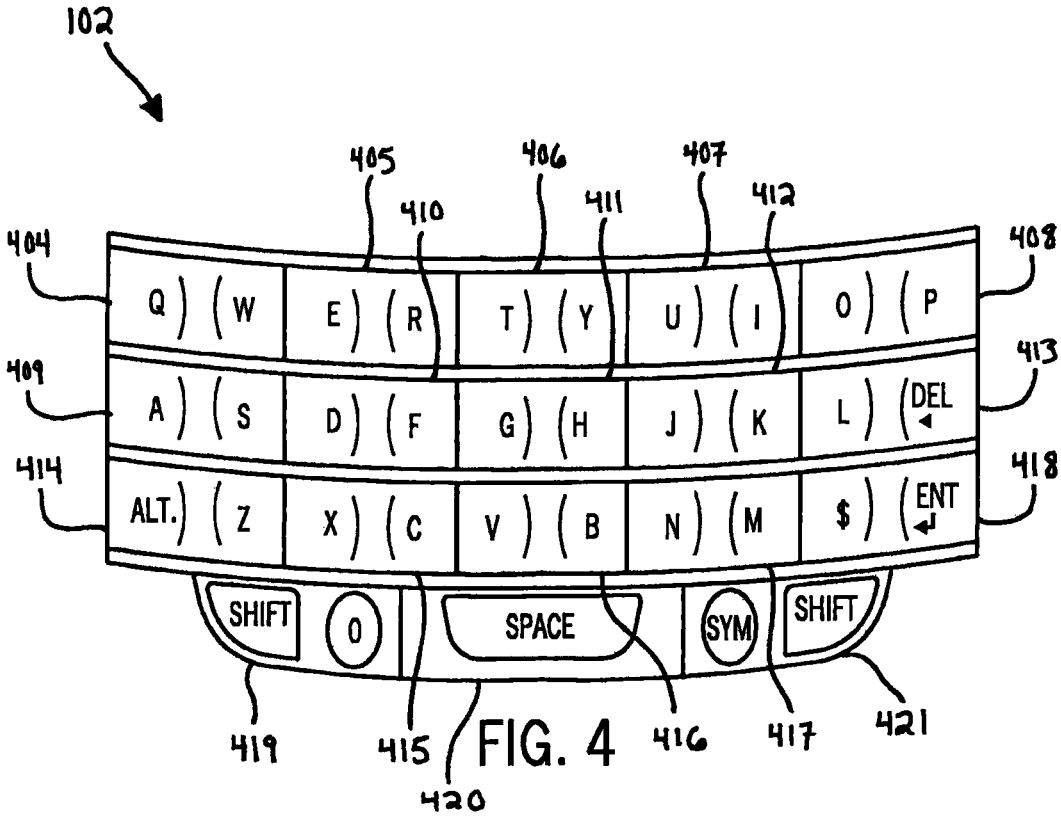
FIG. 4 is a front view of the key assembly of FIG. 1.

According to some embodiments, a key assembly for an electronic device comprises at least one pair of switches and a deflection web disposed adjacent the at least one pair of switches. The deflection web includes at least one pair of actuators. The key assembly further comprises at least one key supported by the at least one pair of actuators opposite the at least one pair of switches. The at least one key includes a body having a first external contact portion that is movable to move a first actuator of the at least one pair of actuators to thereby actuate a first switch of the at least one pair of switches. The body of the at least one key further includes a second external contact portion that is movable to move a second actuator of the at least one pair of actuators to thereby actuate a second switch of the at least one pair of switches. The body of the at least one key pivots about the first external contact portion when the second external contact portion moves to thereby actuate the second switch. The body of the at least one key also pivots about the second external contact portion when the first external contact portion moves to thereby actuate the first switch.

In some embodiments, the first external contact portion includes at least one of a text character and a functional character and the second external contact portion includes at least one of a text character and a functional character.

In some embodiments, the key assembly further comprises a deflection web support engaging the deflection web and disposed between the deflection web and the at least one pair of switches.

In some embodiments, the deflection web support includes at least one leg disposed between the first actuator and the second actuator.

In some embodiments, the key assembly further comprises a plurality of keys including the at least one key. The plurality of keys defines three rows, and each of the three rows defines a full row of a keypad layout.

In some embodiments, the plurality of keys defines the three rows and five columns.

In some embodiments, the key assembly further comprises another plurality of keys defining one row and three columns.

In some embodiments, the another plurality of keys includes a space key.

In some embodiments, the keypad layout is one of a QWERTY-type keypad layout, a QWERTZ-type keypad layout, an AZERTY-type keypad layout, and a DVORAK-type keypad layout.

In some embodiments, the first external contact portion includes a first post, and the first post contacts the first actuator. The second external contact portion includes a second post, and the second post contacts the second actuator.

In some embodiments, the key assembly further comprises a deflection web support engaging the deflection web and disposed between the deflection web and the at least one pair of switches.

In some embodiments, the deflection web support includes at least one leg disposed between the at least one pair of actuators.

In some embodiments, the first external contact portion includes a concave contact surface, and the second external contact portion includes a concave contact surface.

According to some embodiments, a key assembly for an electronic device comprises a base and a plurality of switches supported by the base. The key assembly further includes a plurality of keys including a first set of double keys. Each of the double keys is movably supported by the base and includes a body having a first external contact portion that is movable to actuate a first switch of the plurality of switches. The body of each double key further includes a second external contact portion that is movable to actuate a second switch of the plurality of switches. The body of each double key pivots about the first external contact portion when the second external contact portion moves toward and actuates the second switch, and the body of each double key pivots about the second external contact portion when the first external contact portion moves toward and actuates the first switch. The key assembly further includes a deflection web disposed between the plurality of keys and the plurality of switches. The deflection web includes a plurality of pairs of actuators, and each pair of actuators supports one of the double keys.

In some embodiments, each first external contact portion includes at least one of a text character and a functional character and each second external contact portion includes at least one of a text character and a functional character.

In some embodiments, the double keys are arranged in five columns with three rows.

In some embodiments, the first external contact portion of each double key is movable toward the plurality of switches to move a first actuator of one of the pairs of actuators and thereby actuate the first switch. The second external contact portion of each double key is movable toward the plurality of switches to move a second actuator of the one of the pairs of actuators and thereby actuate the second switch.

According to some embodiments, a key assembly for an electronic device comprises a base supporting a plurality of switches and a plurality of keys supported by the base. The plurality of keys includes a first set of double keys arranged in five columns with three rows and a second set of keys arranged in three columns with one row. The second set of keys includes double keys and a space key. Each of the double keys is movably supported by the base and includes a body having a first external contact portion that is movable to actuate a first switch of the plurality of switches. The body of each double key further includes a second external contact portion that is movable to actuate a second switch of the plurality of switches. The body of each double key pivots about the first external contact portion when the second external contact portion moves toward and actuates the second switch. The body of each double key also pivots about the second external contact portion when the first external contact portion moves toward and actuates the first switch.

In some embodiments, the key assembly further comprises a deflection web disposed between the plurality of keys and the plurality of switches.

In some embodiments, the deflection web includes a plurality of pairs of actuators, and each pair of actuators supports one of the double keys.

In some embodiments, the first external contact portion of each double key is movable toward the plurality of switches to move a first actuator of one of the pairs of actuators and thereby actuate the first switch, and the second external contact portion of each double key is movable toward the plurality of switches to move a second actuator of the one of the pairs of actuators and thereby actuate the second switch.

In some embodiments, the key assembly further comprises a deflection web support disposed between the deflection web and the plurality of switches. The deflection web support includes a plurality of legs, and each of the plurality of legs is disposed between adjacent actuators of the deflection web.

In some embodiments, each first external contact portion includes at least one of a text character and a functional character and each second external contact portion includes at least one of a text character and a functional character.

The teachings of the present disclosure relate generally to portable electronic devices, e.g., mobile communication devices such as pagers, cellular phones, global positioning system (GPS) navigation devices and other satellite navigation devices, smart phones, wireless organizers, wireless personal digital assistants (PDA), and tablet computers. The portable electronic devices could be devices without wireless communication capabilities such as PDAs, electronic gaming devices, digital photograph albums or picture frames, digital cameras, or digital video recorders. These examples are intended to be non-limiting. It is also possible that the teachings of the present disclosure could be applied to electronic devices other than handheld electronic devices, e.g., notebook computers.

Referring now to FIGS. 1-6, an electronic device 100 including a key assembly 102 in accordance with one embodiment of the present disclosure is illustrated. The key assembly 102 includes a plurality of keys 404-421 (see FIG. 4), and at least some of the keys include two or more text characters (e.g., letters, numbers, punctuation, and symbols) and/or functional characters (e.g., shift, enter, delete, 'SYM', and 'ALT'). In addition, the structure of the keys 404-421 provides pleasing tactile feedback when the keys are depressed. This aspect of the device 100 is described in further detail in the following paragraphs.

The keys 404-419 and 421 are movably supported relative to a base 524 (see FIG. 5) and are referred to herein as "double keys". The double keys 404-419 and 421 include components that are commonly associated with two separate keys. That is, each double key 404-419 and 421 includes a body having two external contact portions 526 (see FIG. 5), and each external contact portion 526 includes a text character or a functional character. As described in further detail below, for each key 404-419 and 421 a first text character is input or a first function is performed when a first external contact portion of the key is pressed and a second text character is input or a second function is performed when a second external contact portion of the key is pressed. For example and referring specifically to FIGS. 5 and 6, if a first external contact portion 526*a* of the key 411 is pressed, the text character "G" is input. If a second external contact portion 526*b* of the key 411 is pressed, the text character "H" is input.

In some embodiments, some of the external contact portions 526 further include a second text or functional character that may be input by first entering an alternate mode, such as by pressing the 'ALT' portion of the key 414, the shift portion of one of the keys 419 and 421, the 'SYM' portion of the key 421, or the like. For example and still referring specifically to FIGS. 5 and 6, if the first external contact portion 526*a* of the key 411 is pressed after pressing the 'ALT' portion of the key 414, the backslash text character is input. If the second external contact portion 526*b* of the key 411 is pressed after pressing the 'ALT' portion of the key 414, the colon text character is input.

In general, a first set of the keys 404-418 are arranged in five columns with three rows, and each row defines a full row of a QWERTY-type keypad. However, other keypad layouts may alternatively be used, such as a DVORAK-type keypad, an alphabetic-type keypad, a QWERTZ-type keypad, an AZERTY-type keypad, or the like. A second set of the keys 419-421 are arranged in three columns with one row below the first set of keys 404-418. In some embodiments, the keys 419-421 provide shift and symbol functions in addition to space and zero keys. The space key 420 need not be a double key.

In some embodiments, each of the double keys 404-419 and 421 has a structure as follows. Each key 404-419 and 421 comprises a rigid plastic, such as polycarbonate. Furthermore, in some embodiments, at least some of the external contact portions 526 are transparent or include a window for permitting light generated within the mobile device 100 (e.g., by LEDs on the base 524) to travel through and thereby illuminate the keys.

The external contact portions 526 each have a curved and concave contact surface 528 (FIG. 5) that comfortably accommodates a user's finger. In some embodiments, these contact surfaces 528 may face opposite directions (e.g., key 411). In other embodiments, the contact surfaces 528 may face the same direction, or some of the contact surfaces 528 may face opposite directions and others of the contact surfaces 528 may face the same direction to provide tactile indicators for specific keys. For example, in the embodiment shown in the figures, the double keys in the center column (i.e., keys 406, 411, and 416) have contact surfaces 528 that face opposite directions. In addition, the double keys in the first two columns (i.e., keys 404, 405, 409, 410, 414, and 415) have contact surfaces 528 that face the center column of double keys (i.e., towards the right), and the last two columns (i.e., keys 407, 408, 412, 413, 417, and 418) have contact surfaces 528 that face the center column of the double keys (i.e., toward the left). This arrangement provides an appropriate fit for a user's left and right thumb when typing on the left and right sides, respectively, of the key assembly 102.

In any case, each of the double keys 404-419 and 421 further includes two posts 530 that extend in a direction generally opposite the contact surfaces 528. A first post 530 is disposed opposite a first contact surface 528*a*, and a second post 530 is disposed opposite a second contact surface 528*b*. For example, the double key 411 includes the first external contact portion 526*a* having a first post 530*a* disposed opposite the first contact surface 528*a* and the second external contact portion 526*b* having a second post 530*b* disposed opposite the second contact surface 528*b*.

The posts 530 of the keys 404-421 engage a deflection web 532 (see FIG. 5) disposed between the keys and the base 524. The deflection web 532 includes a plurality of actuators 534 integrally joined to web connectors 536. The web connectors 536 connect the actuators 534 to provide stability and hold the actuators 534 in place within the key assembly 102. In the embodiment shown in the figures, the web connectors 536 join all of the actuators 534. It will be appreciated, however, that in other embodiments, subsets of the actuators 534 may be joined to different subsets of web connectors 536.

The actuators 534 and the web connectors 536 are formed of a flexible material, such as silicone rubber, in order to accommodate motion of the keys 404-421 when they are pressed. However, it will be appreciated that in other embodiments other materials may be used. For example, in some embodiments, the deflection web 532 or a portion thereof is comprised of a clear material which permits light transmission. The deflection web 532 may thus act as a light guide, permitting light generated on one side of the actuators 534 (e.g., by LEDs on the base 524) to travel toward and thereby illuminate the keys 404-421.

Figure 5:
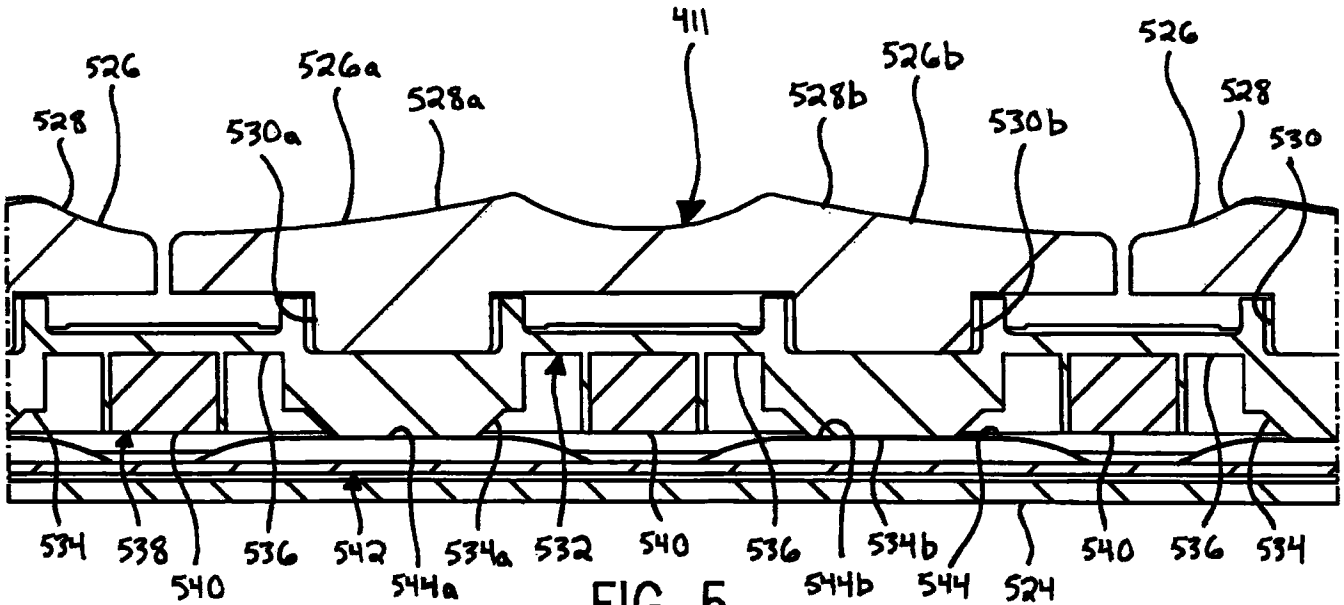
FIG. 5 is a cross-sectional view of the key assembly as viewed along line 5-5 in FIG. 3.

Referring specifically to FIG. 5, pairs of the actuators 534 each support one of the double keys 404-419 and 421. That is, a first actuator of each pair of actuators supports and is moved by the first external contact portion of one of the double keys, and a second actuator of each pair of actuators supports and is moved by the second external contact portion of one of the double keys. For example, a first actuator 534*a* supports and is moved by the first external contact portion 526*a* of the double key 411, and a second actuator 534*b* supports and is moved by the second external contact portion 526*b* of the double key 411. Contact with multiple actuators 534 provides better support for the double keys 404-419 and 421 compared to common "single keys". As such, the double keys 404-419 and 421 are relatively stable and are less likely to become separated from the deflection web 532, e.g., if the key assembly 102 is struck by another object.

Figure 6:
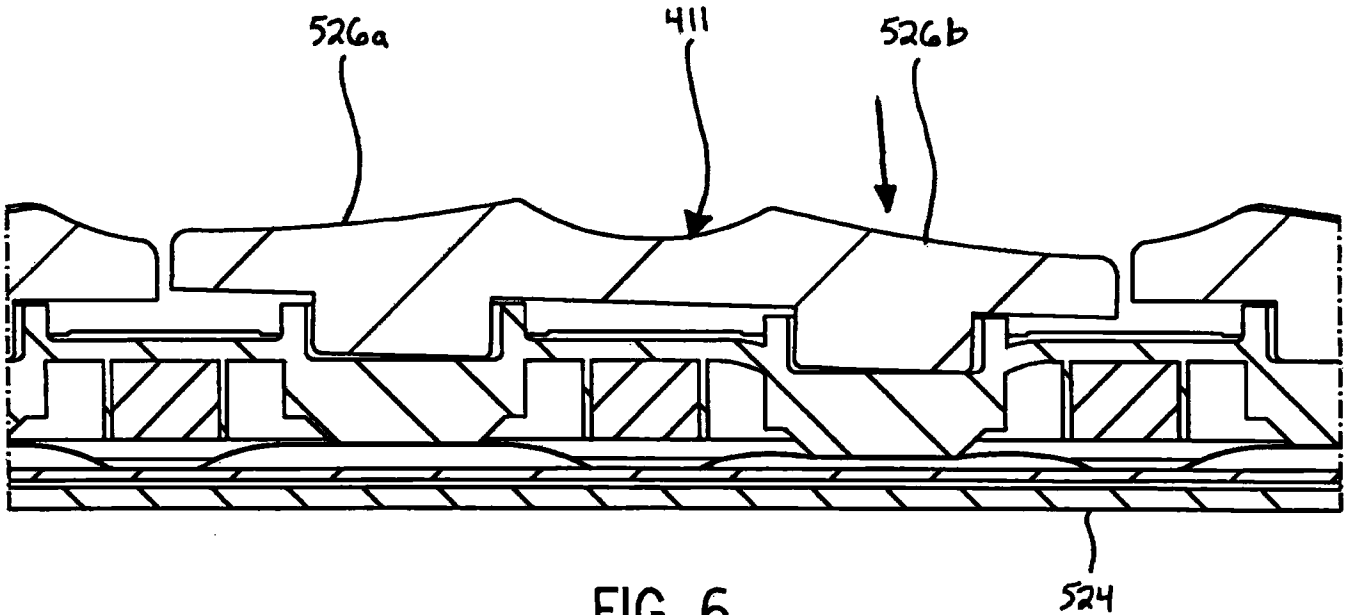
FIG. 6 is a cross-sectional view of the key assembly as viewed along line 5-5 in FIG. 3 with one of the keys being actuated.

Furthermore, a pair of the actuators 534 supporting a double key as described above, together with the absence of any additional pivot structures or supports directly contacting the double keys, permits the double keys to move as follows and as shown in FIG. 6. The body of each double key 404-419 and 421 pivots about the first external contact portion (e.g., the first external contact portion 526*a* of key 411) when the second external contact portion (e.g., the second external contact portion 526*b* of key 411) is pressed and moves toward the base 524. Similarly, the body of each double key 404-419 and 421 pivots about the second external contact portion when the first external contact portion is pressed and moves toward the base 524. In both cases, the keys do not deform and, as such, only provide a small resistance force. Such a small resistance force, together with the key motion described above, provides pleasing tactile feedback.

In some embodiments, the key assembly 102 further includes a deflection web support 538 disposed between the deflection web 532 and the base 524. The deflection web support 538 includes a plurality of support legs 540 that are spaced apart such that the actuators 534 extend between adjacent legs 540. As such, the deflection web support 538 permits an actuator 534 to move toward the base 524 when the corresponding external contact portion 526 is pressed; however, the deflection web support 538 also prevents the other actuators 534 from moving when the same external contact portion 526 is pressed.

The deflection web support 538 comprises a rigid plastic, such as a polycarbonate. The support 538 may also act as a light guide for internal light transmitted to the keys 404-421, and as such, may comprise a transparent or translucent rigid plastic.

Still referring specifically to FIGS. 5 and 6, the base 524 also supports a dome sheet 542 having a plurality of dome switches 544. Pairs of the dome switches 544 each correspond to one of the double keys 404-419 and 421, and each of the dome switches 544 corresponds to one of the external contact portions 526 of a key 404-421. As such, an external contact portion 526 may be pressed to move the corresponding actuator 534 toward the base 524 and thereby actuate the corresponding dome switch 544. For example, the first external contact portion 526*a* of the double key 411 may be pressed to move the corresponding actuator 534*a* toward the base 524 and thereby actuate a first dome switch 544*a*. The second external contact portion 526*b* of the double key 411 may be pressed to move the corresponding actuator 534*b* toward the base 524 and thereby actuate a second dome switch 544*b*.

In some embodiments, each dome switch 544 comprises a polyethylene terephthalate (PET) film which overlays a collapsible metal dome having a nickel plating over a gold plating on a flexible printed circuit board. When an external contact portion 526 is pressed, the dome of the corresponding dome switch collapses thereby connecting conductive platings on an adjacent printed circuit board and completing a connection therebetween. Such an action inputs a signal corresponding to the external contact portion's text or functional character to the mobile device 100.

From the above description, it should be appreciated that the double keys are more stable than common "single keys" because each double key has multiple features in contact with the components there below (e.g., the deflection web). These features essentially provide a greater width over which each double key is supported compared to common "single keys". Furthermore, the double keys are less likely to become separated from the device, e.g., if the key assembly is struck by another object.

Figure 7:
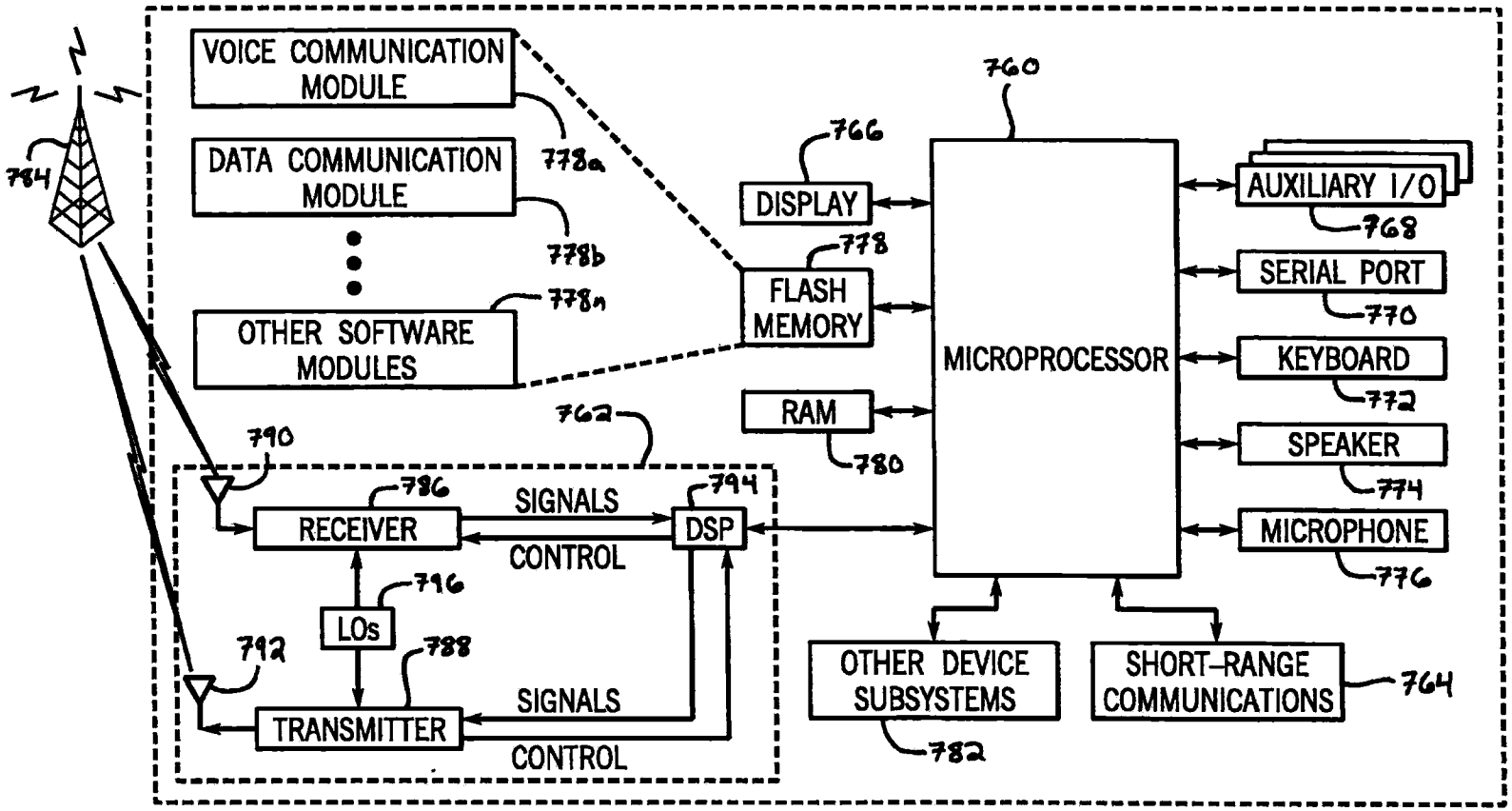
FIG. 7 is a block diagram of the electronic device of FIG. 1.

Referring now to FIG. 7, a block diagram of an exemplary mobile device 100 including key assembly 102 is illustrated. The mobile device 100 includes a processing device 760, a communications subsystem 762, a short-range communications subsystem 764, input/output devices 766, 768, 770, 772, 774, 776, memory devices 778, 780, and various other device subsystems 782. The mobile device 100 is preferably a two-way communication device having voice and data communication capabilities. In addition, the device 100 preferably has the capability to communicate with other computer systems via the Internet.

The processing device 760 controls the overall operation of the mobile device 100. Operating system software executed by the processing device 760 is preferably stored in a persistent store, such as a flash memory 778, but may also be stored in other types of memory devices, such as a read only memory (ROM) or similar storage element. In addition, system software, specific device applications, or parts thereof, may be temporarily loaded into a volatile store, such as a random access memory (RAM) 780. Communication signals received by the mobile device 100 may also be stored to RAM 780.

The processing device 760, in addition to its operating system functions, enables execution of software applications 778*a*-778*n* on the device 100. A predetermined set of applications that control basic device operations, such as data and voice communications 778*a*, 778*b* may be installed on the device 100 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 784. Preferably, the PIM data items are seamlessly integrated, synchronized and updated via the wireless network 784 with the device user's corresponding data items stored or associated with a host computer system. An example system and method for accomplishing these steps is disclosed in "System And Method For Pushing Information From A Host System To A Mobile Device Having A Shared Electronic Address", U.S. Pat. No. 6,219,694, which is owned by the assignee of the present application, and which is incorporated herein by reference.

Communication functions, including data and voice communications, are performed through the communication subsystem 762, and possibly through the short-range communications subsystem 764. The communication subsystem 762 includes a receiver 786, a transmitter 788 and one or more antennas 790, 792. In addition, the communication subsystem 762 also includes a processing module, such as a digital signal processor (DSP) 794, and local oscillators (LOs) 796. The specific design and implementation of the communication subsystem 762 is dependent upon the communication network in which the mobile device 100 is intended to operate. For example, a mobile device 100 may include a communication subsystem 762 designed to operate with the Mobitex™ DataTAC™ or General Packet Radio Service (GPRS) mobile data communication networks and also designed to operated with any of a variety of voice communication networks, such as AMPS, TDMA, CDMA, PCS, GSM, etc. Other types of data and voice networks, both separate and integrated, may also be utilized with the mobile device 100.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 100 may send and receive communication signals over the communication network 784. Signals received by the antenna 790 from the communication network 784 are routed to the receiver 786, which provides for signal amplification, frequency down conversion, filtering, channel selection, etc., and may also provide analog to digital conversion. Analog-to-digital conversion of the received signal allows the DSP to perform more complex communication functions, such as demodulation and decoding. In a similar manner, signals to be transmitted to the network 784 are processed (e.g., modulated and encoded) by the DSP 794 and are then provided to the transmitter 788 for digital to analog conversion, frequency up conversion, filtering, amplification and transmission to the communication network 784 (or networks) via the antenna 792.

In addition to processing communication signals, the DSP 794 provides for receiver 786 and transmitter 788 control. For example, gains applied to communication signals in the receiver 786 and transmitter 788 may be adaptively controlled through automatic gain control algorithms implemented in the DSP 794.

In a data communication mode, a received signal, such as a text message or web page download, is processed by the communication subsystem 762 and input to the processing device 760. The received signal is then further processed by the processing device 760 for output to a display 766, or alternatively to some other auxiliary I/O device 768. A device user may also compose data items, such as e-mail messages, using the key assembly 102 and/or some other auxiliary I/O device 768, such as a touchpad, a rocker switch, a thumbwheel, or the like. The composed data items may then be transmitted over the communication network 784 via the communication subsystem 762.

In a voice communication mode, overall operation of the device is substantially similar to the data communication mode, except that received signals are output to a speaker 774, and signals for transmission are generated by a microphone 776. Alternative voice or audio I/O subsystems, such as a voice message recording subsystem, may also be implemented on the device 100. In addition, the display 766 may also be utilized in voice communication mode, for example to display the identity of a calling party, the duration of a voice call, or other voice call related information.

The short-range communications subsystem 764 enables communication between the mobile device 100 and other proximate systems or devices, which need not necessarily be similar devices. For example, the short-range communications subsystem 764 may include an infrared device and associated circuits and components, or a Bluetooth™ communication module to provide for communication with similarly-enabled systems and devices.

The various embodiments presented above are merely examples and are in no way meant to limit the scope of this disclosure. Variations of the embodiments described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

What is claimed is:

1. A key assembly for an electronic device, the key assembly comprising:

at least one pair of switches;

a deflection web disposed adjacent the at least one pair of switches and including at least one pair of actuators;

a plurality of keys including:

a first set of double keys arranged in five columns with three rows;

a second set of keys arranged in three columns with one row, the second set of keys including double keys and a space key;

at least one of the double keys being supported by the at least one pair of actuators opposite the at least one pair of switches and including a body having:

a first external contact portion being movable to move a first actuator of the at least one pair of actuators to thereby actuate a first switch of the at least one pair of switches;

a second external contact portion being movable to move a second actuator of the at least one pair of actuators to thereby actuate a second switch of the at least one pair of switches; and wherein the body of the at least one double key pivots about the first external contact portion when the second external contact portion moves to thereby actuate the second switch, and the body of the at least one double key pivots about the second external contact portion when the first external contact portion moves to thereby actuate the first switch.

2. The key assembly of claim 1, wherein the first external contact portion includes at least one of a text character and a functional character and the second external contact portion includes at least one of a text character and a functional character.

3. The key assembly of claim 1, further comprising a deflection web support engaging the deflection web and disposed between the deflection web and the at least one pair of switches.

4. The key assembly of claim 3, wherein the deflection web support includes at least one leg disposed between the first actuator and the second actuator.

5. The key assembly of claim 1, wherein the keypad layout is one of a QWERTY-type keypad layout, a QWERTZ-type keypad layout, an AZERTY-type keypad layout, and a DVORAK-type keypad layout.

6. The key assembly of claim 1, wherein the first external contact portion includes a first post, the first post contacting the first actuator, and the second external contact portion includes a second post, the second post contacting the second actuator.

7. The key assembly of claim 1, wherein the first external contact portion includes a concave contact surface, and the second external contact portion includes a concave contact surface.

8. A key assembly for an electronic device, the key assembly comprising:

a base;

a plurality of switches supported by the base;

a plurality of keys including:

a first set of double keys arranged in five columns with three rows;

a second set of keys arranged in three columns with one row, the second set of keys including double keys and a space key;

each of the double keys being movably supported by the base and including a body having:

a first external contact portion being movable to actuate a first switch of the plurality of switches;

a second external contact portion being movable to actuate a second switch of the plurality of switches;

wherein the body of each double key pivots about the first external contact portion when the second external contact portion moves toward and actuates the second switch, and the body of each double key pivots about the second external contact portion when the first external contact portion moves toward and actuates the first switch; and a deflection web disposed between the plurality of keys and the plurality of switches, the deflection web including a plurality of pairs of actuators, and each pair of actuators supports one of the double keys.

9. The key assembly of claim 8, wherein each first external contact portion includes at least one of a text character and a functional character and each second external contact portion includes at least one of a text character and a functional character.

10. The key assembly of claim 8, wherein the first external contact portion of each double key is movable toward the plurality of switches to move a first actuator of one of the pairs of actuators and thereby actuate the first switch, and the second external contact portion of each double key is movable toward the plurality of switches to move a second actuator of the one of the pairs of actuators and thereby actuate the second switch.

11. A key assembly for an electronic device, the key assembly comprising:

a base supporting a plurality of switches;

a plurality of keys supported by the base, the plurality of keys including:

a first set of double keys arranged in five columns with three rows;

a second set of keys arranged in three columns with one row, the second set of keys including double keys and a space key;

each of the double keys being movably supported by the base and including a body having:

a first external contact portion being movable to actuate a first switch of the plurality of switches;

a second external contact portion being movable to actuate a second switch of the plurality of switches;

wherein the body of each double key pivots about the first external contact portion when the second external contact portion moves toward and actuates the second switch, and the body of each double key pivots about the second external contact portion when the first external contact portion moves toward and actuates the first switch.

12. The key assembly of claim 11, further comprising a deflection web disposed between the plurality of keys and the plurality of switches.

13. The key assembly of claim 12, further comprising a deflection web support disposed between the deflection web and the plurality of switches, the deflection web support including a plurality of legs, each of the plurality of legs being disposed between adjacent actuators of the deflection web.

14. The key assembly of claim 11, wherein each first external contact portion includes at least one of a text character and a functional character and each second external contact portion includes at least one of a text character and a functional character.

* * * * *